US006226896B1

(12) United States Patent
Friton

(10) Patent No.: US 6,226,896 B1
(45) **Date of Patent: *May 8, 2001**

(54) FOOTWEAR WITH MOUNTAIN GOAT TRACTION ELEMENTS

(75) Inventor: Michael Ray Friton, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/466,547

(22) Filed: Dec. 17, 1999

Related U.S. Application Data

(63) Continuation of application No. 09/259,271, filed on Mar. 1, 1999, now Pat. No. 6,018,889, which is a continuation of application No. 08/785,666, filed on Jan. 17, 1997, now Pat. No. 5,926,974.

(51) Int. Cl.[7] ..... A43B 13/18; A43C 15/02

(52) U.S. Cl. ..... 36/28; 36/31; 36/59 C; 36/59 A; 36/32 R; 36/25 R

(58) Field of Search ..... D2/959; 36/28, 36/31, 59 A, 59 C, 29, 32 R, 11.5, 25 R

(56) References Cited

U.S. PATENT DOCUMENTS

| | | | |
|---|---|---|---|
| 33,436 | | 10/1861 | Kinsley . |
| D. 229,456 | * | 12/1973 | Plampton et al. . |
| D. 341,481 | * | 11/1993 | Peterson . |
| D. 356,672 | * | 3/1995 | Ueda . |
| D. 358,929 | * | 6/1995 | Peterson . |
| D. 371,893 | * | 7/1996 | Kayano et al. . |
| 554,988 | | 2/1896 | Cushing . |
| 665,797 | | 1/1901 | Newton . |
| 879,732 | | 2/1908 | Busby . |
| 1,124,988 | | 1/1915 | Witter . |
| 1,344,972 | | 6/1920 | Armour . |
| 1,350,839 | | 8/1920 | Rendle . |
| 2,303,744 | | 12/1942 | Jacobs . |

(List continued on next page.)

FOREIGN PATENT DOCUMENTS

| | | |
|---|---|---|
| 90 11 076 U | 10/1990 | (DE) . |
| 83 32 728 | 9/1991 | (DE) . |
| 0 363 217 | 4/1990 | (EP) . |
| 473 286 | 10/1937 | (GB) . |
| 2073006 | 10/1981 | (GB) . |

*Primary Examiner*—Ted Kavanaugh
(74) *Attorney, Agent, or Firm*—Banner & Witcoff, Ltd.

(57) ABSTRACT

Footwear intended primarily for outdoor use, wherein a variety of ground conditions are likely to be encountered, has a sole with traction elements inspired by the hoof of a mountain goat. In several embodiments, an interior region of the sole is provided with a plurality of pairs of relatively soft protruding pods, while a perimetric region surrounding the interior region includes a plurality of relatively hard lugs provided on opposite sides of the pod pairs. The pods extend downwardly below the lugs such that they will make initial ground contact and compress. The compression cushions initial impact and increases the area of ground contact to improve traction on firm smooth surfaces. The compression also brings the lugs into ground engagement, following initial contact, to improve stability and traction on irregular and soft ground surfaces. Other embodiments of the invention implement similar principles, in soles having a more conventional (less goat hoof-like) appearance. In one embodiment, relatively soft rubber outsole lugs take the place of the pods. In another embodiment, the sole includes combination lugs including relatively hard and soft portions of differing height. In a further embodiment, an interior region of a water sandal sole includes relatively soft traction elements in the form of relatively large soft regions of the midsole covered with a thin layer of rubber outsole material; the interior region is surrounded by a perimeter of hard lugs.

6 Claims, 16 Drawing Sheets

U.S. PATENT DOCUMENTS

| | | | |
|---|---|---|---|
| 2,423,753 | | 7/1947 | Brooks . |
| 2,844,833 | | 7/1958 | Odermatt . |
| 4,083,125 | | 4/1978 | Benseler et al. . |
| 4,085,527 | | 4/1978 | Riggs . |
| 4,130,947 | | 12/1978 | Denu . |
| 4,141,158 | | 2/1979 | Benseler et al. . |
| 4,161,828 | | 7/1979 | Benseler et al. . |
| 4,398,357 | | 8/1983 | Batra . |
| 4,641,438 | * | 2/1987 | Laird et al. . |
| 4,748,750 | | 6/1988 | George . |
| 4,769,931 | | 9/1988 | Morrow et al. . |
| 4,833,796 | | 5/1989 | Flemming . |
| 4,897,936 | | 2/1990 | Fuerst . |
| 4,934,071 | | 6/1990 | Virgini . |
| 5,077,916 | | 1/1992 | Beneteau . |
| 5,367,791 | | 11/1994 | Gross et al. . |
| 5,416,986 | | 5/1995 | Cole et al. . |
| 5,675,914 | | 10/1997 | Cintron . |
| 5,768,802 | | 6/1998 | Bramani . |
| 5,775,005 | | 7/1998 | McClelland . |
| 5,926,974 | * | 7/1999 | Friton . |
| 6,018,889 | * | 2/2000 | Friton . |

* cited by examiner

FOOTWEAR WITH MOUNTAIN GOAT TRACTION ELEMENTS

This application is a Continuation of application Ser. No. 09/259,271, filed Mar. 1, 1999 now U.S. Pat. No. 6,018,889, which is a Continuation of application Ser. No. 08/785,666, filed Jan. 17, 1997 now U.S. Pat. No. 5,926,974.

BACKGROUND OF THE INVENTION

The present invention relates to footwear, and in particular athletic and recreational footwear, e.g., running shoes, hiking shoes and sandals, used in conditions in which a variety of ground surfaces are typically encountered.

Modern athletic and recreational shoes typically comprise a highly refined combination of elements configured with the goal of optimally balancing, in light of the sport or activity for which the shoe is designed, the often competing concerns of cushioning, stability, durability and traction. The modern athletic or recreational shoe ordinarily has a multilayer sole construction comprised of an outsole, a midsole and an insole. The outsole is normally formed of a durable material such as rubber to resist wearing of the sole during use. In many cases, the outsole includes lugs, cleats or other elements to enhance traction. The midsole ordinarily forms the middle layer of the sole and is typically composed of a soft foam material, e.g., foamed polyurethane or EVA, to cushion the impact forces experienced by the foot during athletic or recreational activities. In order to further enhance cushioning and reduce weight, it is known to incorporate within the midsole special cushioning elements, such as resilient fluid bladders, as taught in U.S. Pat. Nos. 4,183,156; 4,219,945; 4,340,626 to Rudy and 4,813,302 to Parker et al.

Recently, interest has grown considerably in lightweight athletic and recreational shoes specially configured for outdoor use. Lightweight materials and constructions developed for athletic shoes used primarily on level planar surfaces, e.g., running, basketball, baseball and tennis, have made their way into the hiking arena, replacing the traditional bulky, heavy and stiff leather hiking boot. This evolution, and the consequent availability of lightweight trail shoes, e.g., the NIKE Mada and Terra trail shoes, has spurred the growth of trail running as a sporting event and form of conditioning. The same technologies have been utilized to provide improved sandals, e.g., the NIKE Terra and Deschutz sandals, for use in wet and/or dry outdoor conditions, e.g., beach environments. In hiking, trail running, beach combing and other outdoor activities, a variety of ground conditions are likely to be encountered, vis, surfaces which are loose and firm, smooth and irregular, soft and hard, wet and dry, and inclined and level.

Athletic and recreational shoes of known types are not ideally suited for the wide variety of ground conditions that may be encountered in the aforementioned outdoor activities. Rather, to a significant degree, suitability for one type of ground condition has been achieved at the expense of suitability for other conditions. In particular, the soles of known athletic shoes generally do not provide an optimized balance of cushioning, stability and traction for diverse ground conditions. On one hand, a pattern of relatively deep, hard (stiff) outsole lugs, e.g., as provided in known hiking boots and trail shoes, is desirable to provide traction on soft, loose and/or irregular surfaces, but can result in less than ideal traction on smoother firmer surfaces. On the other hand, traction is enhanced on smooth and firm ground surfaces by softer sole elements which compress to increase the area of contact between the ground surface and the sole. Additionally, softer sole elements can afford greater stability and comfort due to their increased shock absorbing capabilities and ability to conform to small surface irregularities, e.g., small rocks. But, such relatively soft elements generally lack the aforementioned desirable traction characteristics of hard lugs.

The effectiveness of a mountain goat's hoof in providing that animal with sure footing on diverse and extreme ground conditions has been recognized. As described in the book entitled *Beast the Color of Winter, the Mountain Goat Observed,* by Douglas H. Chadwick, Sierra Club pub. (1983), "[t]he sides of a mountain goat's toes consist of the same hard keratin found on the hoof of a horse or deer. Each of the two wrap around toenails can be used to catch and hold to a crack or tiny knob of rock ... The mountain goat is shod with a special traction pad which protrudes slightly past the nail. This pad has a rough textured surface that provides a considerable amount of extra friction on smooth rock and ice. Yet it is pliant enough for any irregularities in a stone substrate to become impressed in it and thereby add to the skidproofing effect."

The V-shape of the mountain goat's hoof has additional benefits that are illustrated by the following further description provided in the aforementioned book: "Make a wide V with your index and middle fingers and try pressing down against something with their tips. Since walking on an artiodactyl hoof is anatomically similar to walking on the tips of two fingers, the mountain goat feels the muscles and tendons working against each other somewhat the way you do. It adjusts the tensions accordingly in order to fine-tune its grip on uneven surfaces . . . Now you will find that the more weight you put on your fingertips, the more they want to diverge sideways. In like fashion the mountain goat's toes divide the downward force of the weight on a hoof. When your fingers, or the toes of the hoof are placed on an incline surface, part of the weight continues to be directed sideways—a horizontal vector of force as distinct from the vertical vector. There is thus less net force being exerted in a single downward line; hence there is less likelihood of overcoming the force of friction along that line and beginning to slide . . . What is going on here is a fanning out of forces. If all the downward force could be converted into a sideways forces, it would in effect be canceled out . . . The third and final dimension is simpler to explain. Solid rock, talus, dirt or snow can become wedged in the crotch of the V and act as an additional brake."

To a limited degree, features from animal anatomies have been adapted for incorporation into shoe sole designs. Morrow et al. U.S. Pat. No. 4,769,931 discloses a cleated sole for footwear. The cleats are shaped and arranged in pairs to simulate animal hooves, primarily for the purpose of lessening noise and increasing traction for hunters. According to Morrow et al., a minimization of noise is achieved by limiting wearer contact with the ground. An absence of relatively soft (ground contact increasing) traction elements precludes the possibility of obtaining benefits in traction (as explained above) of the type attained by the mountain goat's soft hoof pads.

In contrast to the Morrow et al. patent, Gross et al. U.S. Pat. No. 5,367,791 discloses an athletic shoe sole construction wherein an insert is provided with relatively soft "tips." According to the patent, the tips are strategically located to absorb shock, add stability and reduce pronation. The tips do not appear configured to simulate an animal hoof in any way. Moreover, an absence of relatively hard traction elements, e.g., lugs, associated with the soft tips precludes benefits in traction similar to those that the mountain goat's toenails provide.

SUMMARY OF THE INVENTION

In view of the foregoing& it is a principal object of the present invention to provide footwear which is ideally suited for outdoor activities in which a wide variety of ground conditions are likely to be encountered.

It is a more specific object of the invention to provide a sole configuration for footwear which maximizes traction and stability over a wide range of ground conditions.

It is a further object of the invention to provide a sole configuration for footwear including soft traction elements which are not prone to excessive wear.

These and other objects are largely achieved by the present invention which, in a first aspect, is embodied in footwear comprising an upper and a cushioning sole attached to the upper. The sole has a ground engaging surface including a group of one or more relatively soft compliant traction elements and a group of one or more relatively hard lugs, stiffer in compression than the traction elements, adjacent the group of traction elements. The traction elements extend downwardly below the lugs such that, in use, a bottom surface of the traction elements will make initial ground contact and partially compress. The compression cushions impact of ground engagement and increases ground contact, and is such that a bottom surface of said lugs is brought into ground contact after the initial ground contact. The lugs limit compression of the traction elements and serve as a relatively rigid catch for irregular and soft ground surfaces.

In a second aspect footwear of the present invention comprises an upper and a cushioning sole attached to said upper. The sole has a ground engaging surface including an outer perimetric border region and an interior region surrounded by the border region. The interior region comprises a group of one or more relatively soft compliant traction elements. The border region comprises a pair of relatively hard lugs, stiffer in compression than the traction elements, adjacent the group of traction elements, at medial and lateral sides thereof The above and other objects, features and advantages of the invention will be readily apparent and fully understood from the following detailed description of preferred embodiments, taken in connection with the appended drawings.

DETAILED DESCRIPTION OF THE PREFERRED EMBODIMENTS

Figure 1:
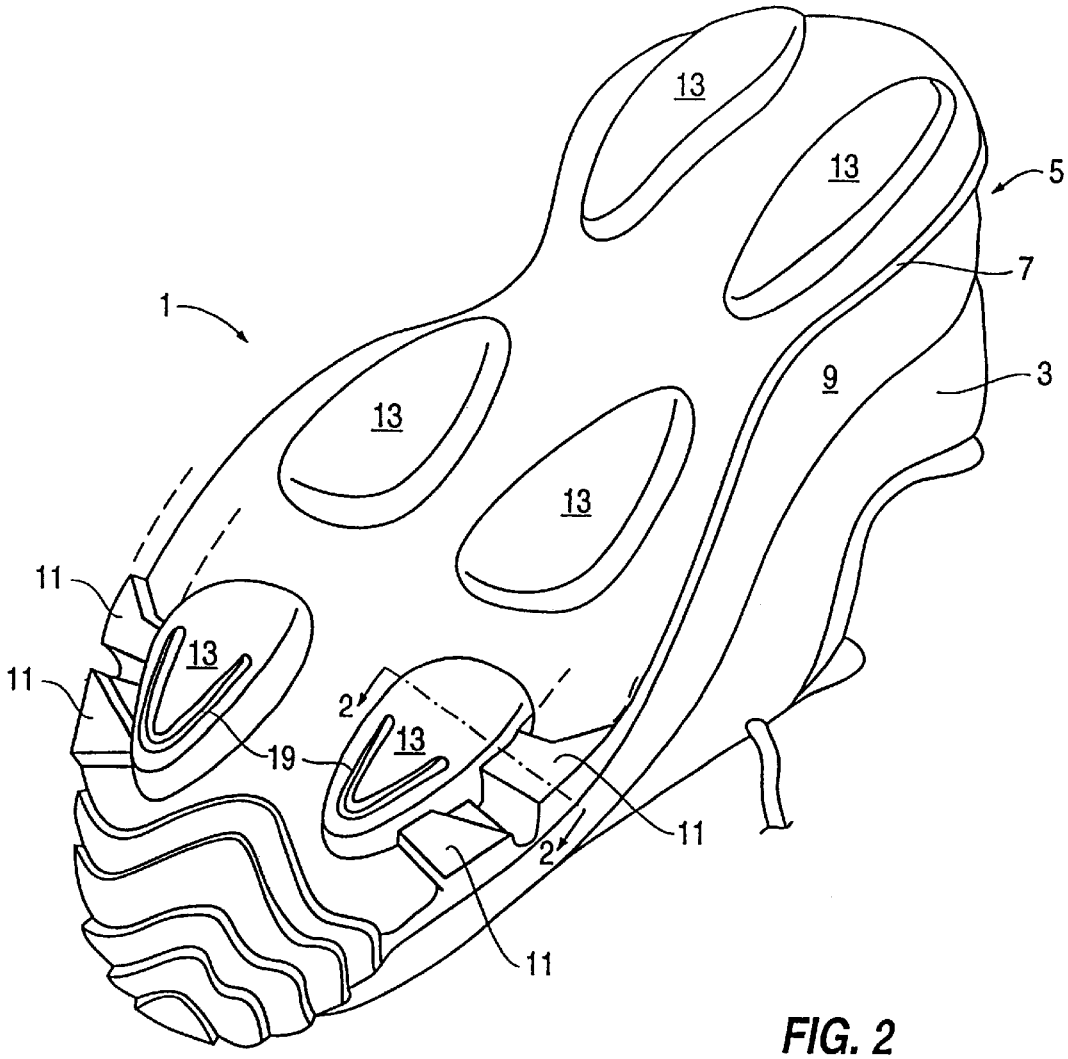
FIG. 1 is a simplified perspective view illustrating a lightweight trail shoe with a sole including traction elements in accordance with the present invention.

Referring first to FIG. 1, a lightweight trail shoe 1 according to the present invention comprises an upper 3 of known construction and a sole 5 attached to upper 3. Sole 5 comprises an outsole 7 of wear resistant material, e.g., rubber, and a midsole 9 of lightweight cushioning material, e.g., foamed polyurethane or EVA. Midsole 9 and outsole 7 together form a ground engaging surface having two groups of traction elements. In a perimetric border region of the sole are a plurality of relatively deep lugs 11 formed of the relatively hard rubber outsole material. Lugs 11 preferably extend along the entire lengths of each of the medial and lateral sides, and may also wrap continuously around the heel region of the sole. An interior region of the sole includes a plurality of pairs of relatively soft and compliant protruding pods 13.

Figure 2:
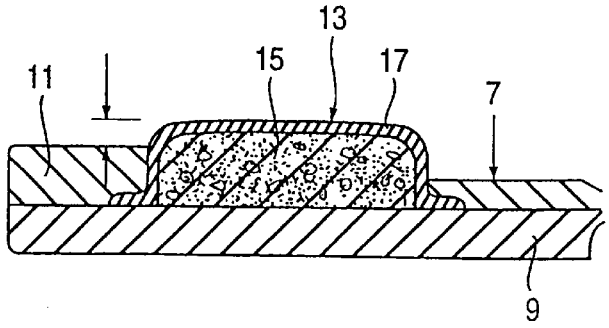
FIG. 2 is a cross-sectional view taken on line 2—2 in FIG. 1.
Figure 3:
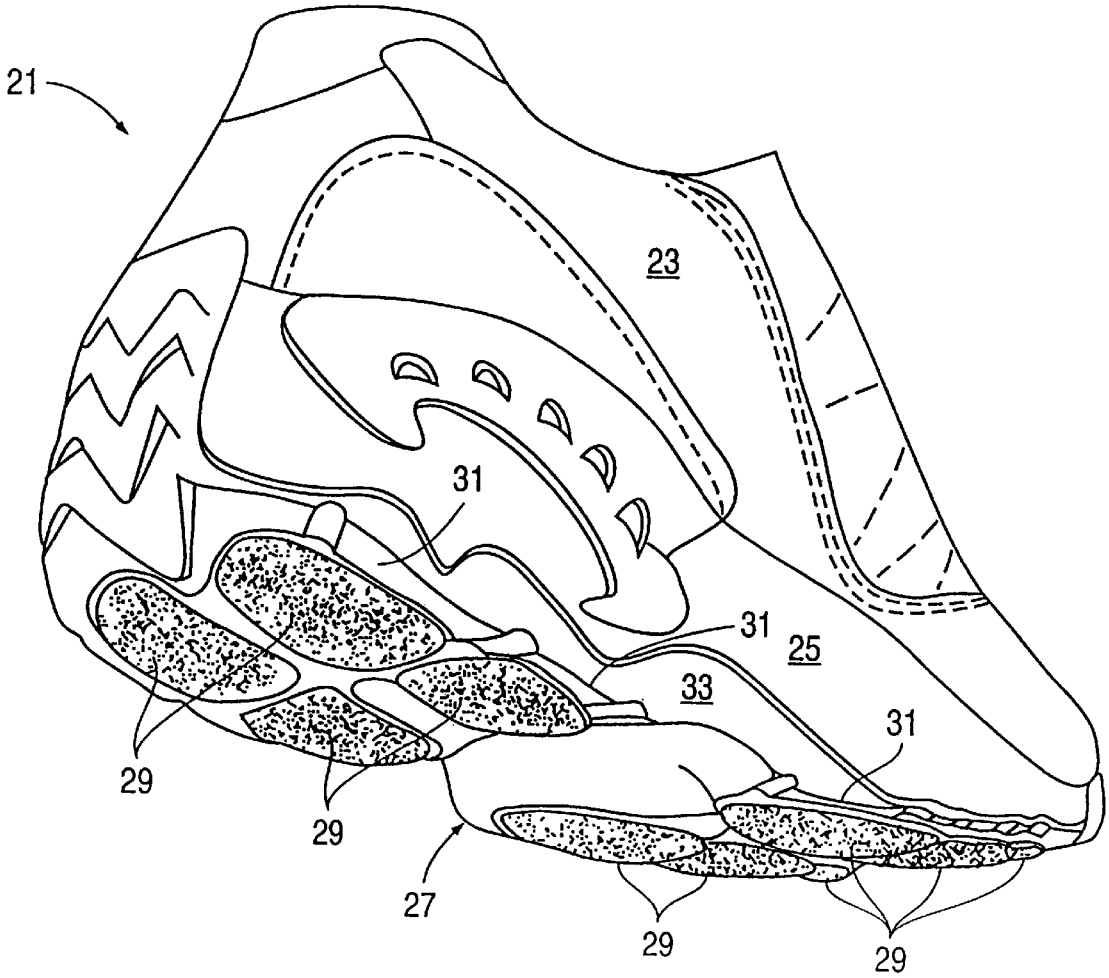
FIG. 3 is a perspective view illustrating a sole construction of a second lightweight trail shoe embodiment of the invention.

As best seen in FIG. 2, pods 13 comprise a core of relatively soft resilient foam material 15 covered with a relatively thin layer 17 of wear resistant material 17. Foam material 15 may be the same material that is used for midsole 9, e.g., Phylon (a foamed EVA). Preferably, material 15 is a different material which is somewhat softer (less stiff in compression). Instead of, or in addition to, a core of soft foam material, other soft cushioning elements can be used, e.g., gas or gel filled bladders. Likewise layer 17 may be of the same material used to form the outsole 7 (including lugs 11), or a different material, e.g., Toughtek (rubber coated elastic textile material). As shown in FIG. 2, layer 17 is a separate piece bonded with the outsole web. However, it will be understood that layer 17 may be formed integrally as part of a single piece outsole.

Pods 13 preferably extend downwardly below lugs 11 such that, in use, a bottom surface of the pods will make initial ground contact and partially compress. The relative hardness (stiffness in compression) of pods 13 should be such that the compression serves to cushion the impact of ground engagement, and to increase the ground contact area (whereby traction is increased). The height difference between lugs 11 and pods 13 should be such as to allow the compression to bring a bottom surface of lugs 11 into ground contact after the initial ground contact. In general, a height differential in the range of 2 mm to 4 mm is preferred.

Lugs 11 should be sufficiently hard and tall as to prevent pods 13 from reaching the limit of their useful compression, i.e., bottoming out. By limiting the compression of the pods, lugs 11 prevent instability and excessive wear of pods 13. The arrangement advantageously allows the use of soft materials which otherwise would wear out too quickly to be practical. Lugs 11 should also be sufficiently thick and hard to serve as a relatively rigid catch for irregular and soft ground surfaces.

In the above manner, the combination of pods 13 and lugs 11 provides stability and two distinctly different typed of traction, similar to the hoof of the mountain goat. Pods 13 act like the soft pads of the mountain goat hoof, providing traction on smooth rock, ice and like surfaces. To enhance traction in this respect, pods 13 may be provided with a rough textured surface. In addition, the pliability of the pods allows surface irregularities to be absorbed to thereby further increase traction and stability. On the other hand, hard lugs 11 act similar to the mountain goat's wrap-around toe nails, to catch and hold on cracks, knobs of rock and the like. To enhance this effect, one or more of pods 13 can be provided with a raised rim 19 of harder rubber, wrapped around the leading edge of the pod.

The particular shape, number and distribution of pods 13 and lugs 11 can be varied. Each pod should be adjacent at least one hard lug, and preferably pairs of lugs 11 are arranged to flank the pod pairs on the medial and lateral sides. Arrangement of the pods in adjacent pairs is desirable in order to obtain the two point stability and traction characteristics provided by the V-shaped hoof of the mountain goat, as discussed in the background section hereinabove. To maintain flexibility, the pods and lugs are preferably spaced such that natural flex lines fall between these elements. While the fullest effect of the invention is achieved with pods and associated lugs provided in at least the forefoot and rearfoot regions, the pods and lugs can be limited to a single one or part of those regions.

FIGS. 3–14 illustrate in detail a second trail shoe embodiment in accordance with the invention. Similar to the first embodiment, shoe 21 comprises an upper 23, and a sole including a midsole 25 and an outsole 27. Midsole 25 and outsole 27 together form an interior region including pairs (four) of relatively soft pods 29 surrounded by a perimetric region including a plurality of relatively hard outsole lugs 31. Lugs 31 have a lower profile (are shallower) than lugs 11 of the first embodiment, thereby allowing a lighter weight construction well suited for trail running and other activities, particularly where extremely rough and loose terrain (for which the deep lugs of the first embodiment are best suited) is not anticipated.

It is seen in FIGS. 3–7, 9 and 14 that outsole 27 has medial and lateral side portions 33, 35 which are considerably built-up in thickness as compared to the rest of the outsole. Such a construction stiffens the sole and provides increased stability on rough terrain.

Figure 4:
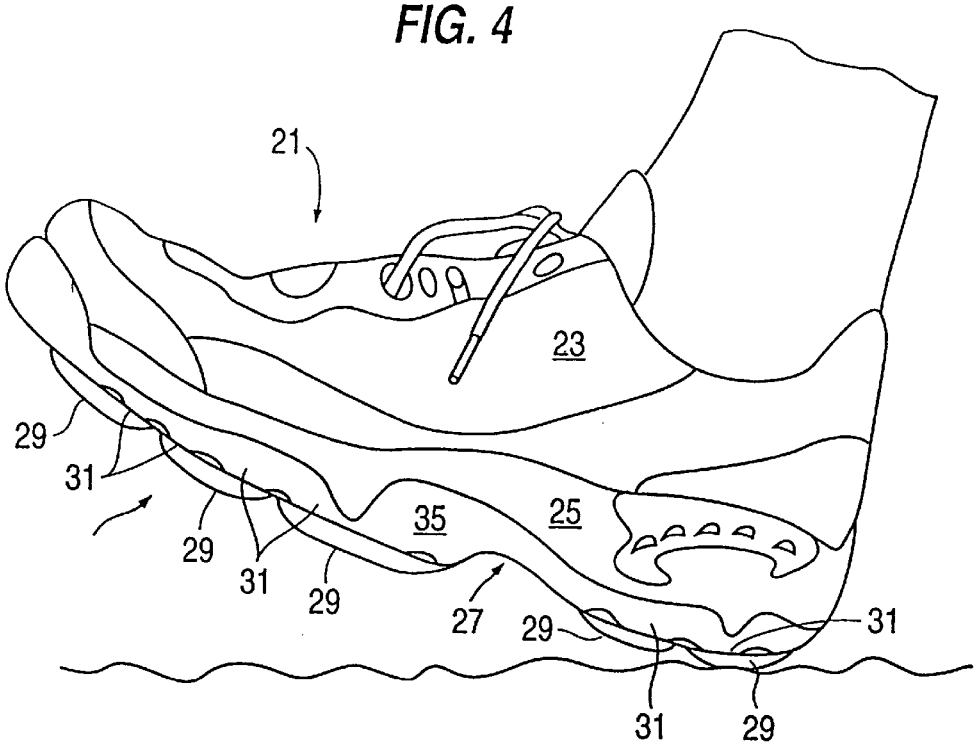
FIGS. 4–7 are lateral side elevation views of the shoe shown in FIG, 3, sequentially illustrating different stages of ground engagement, and associated compression of the sole.
Figure 5:
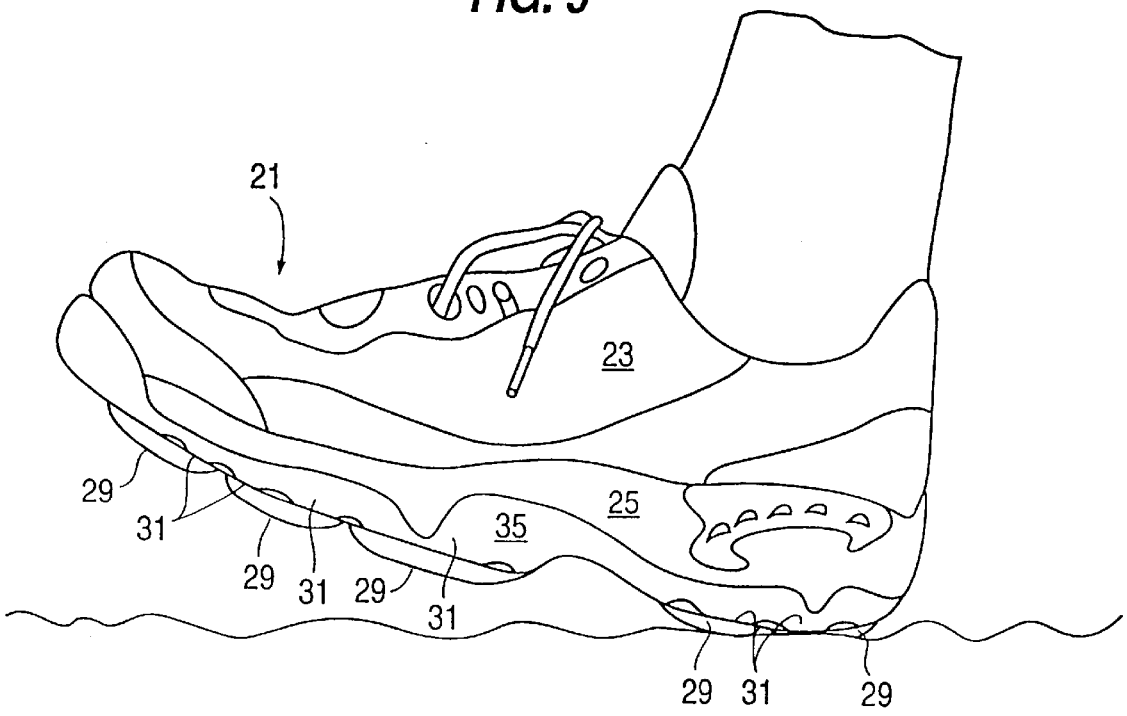
Figure 6:
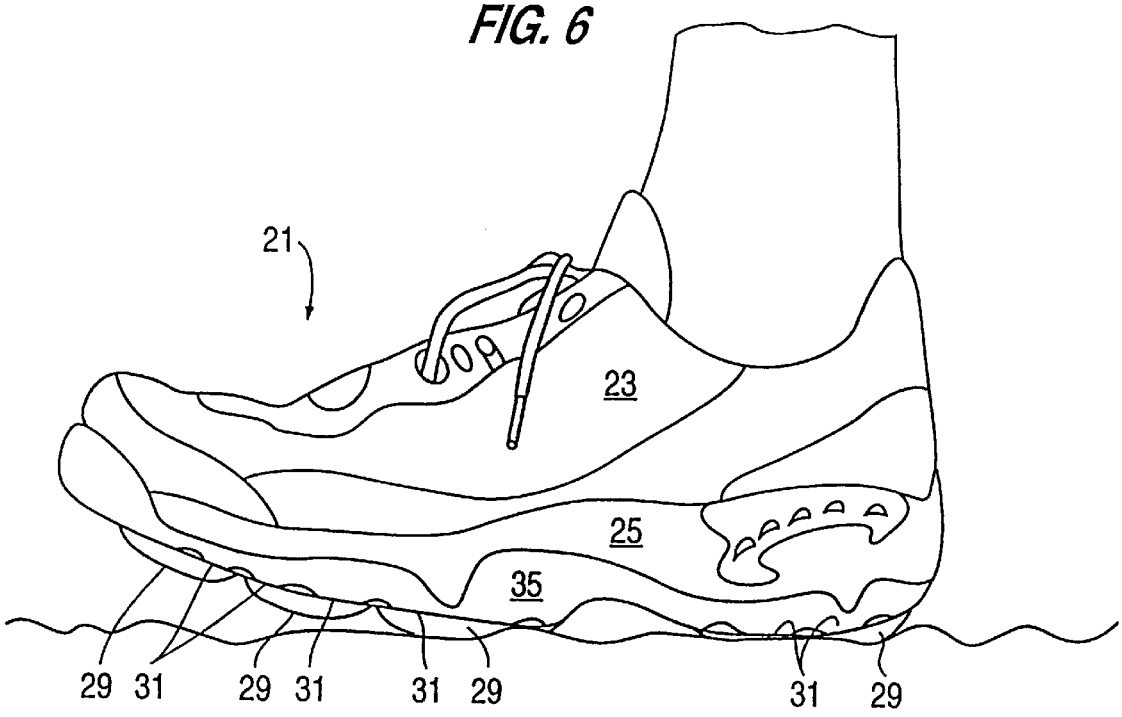
Figure 7:
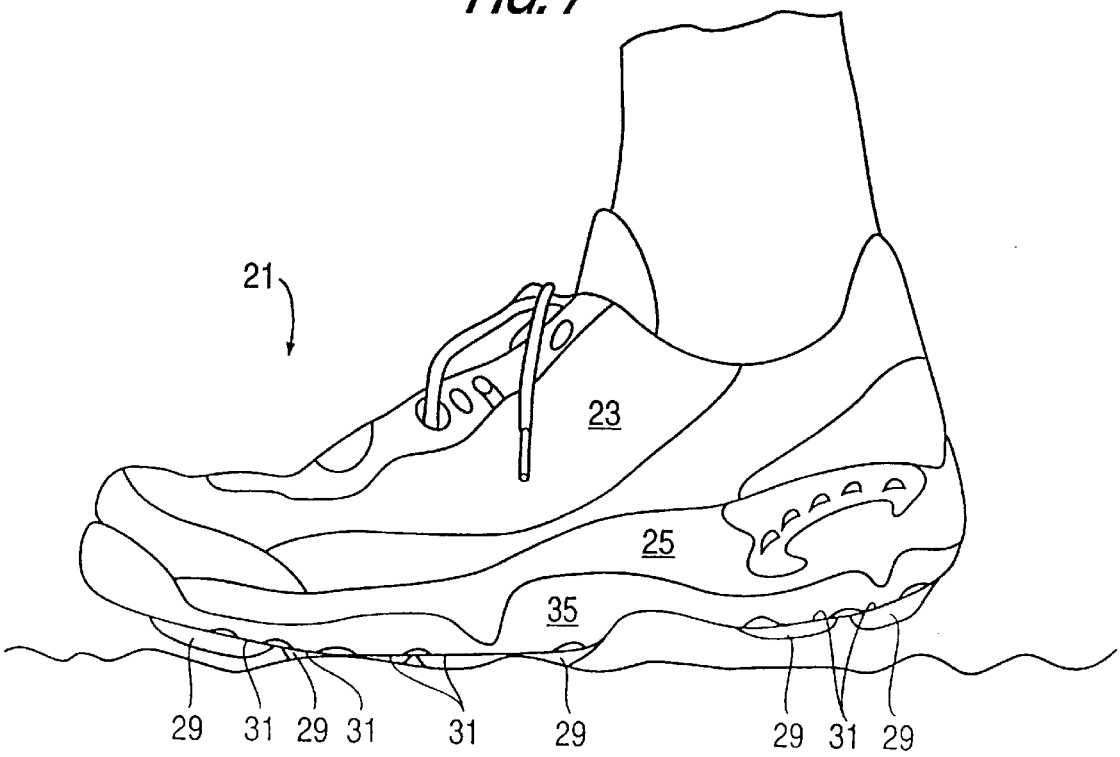
Figure 8:
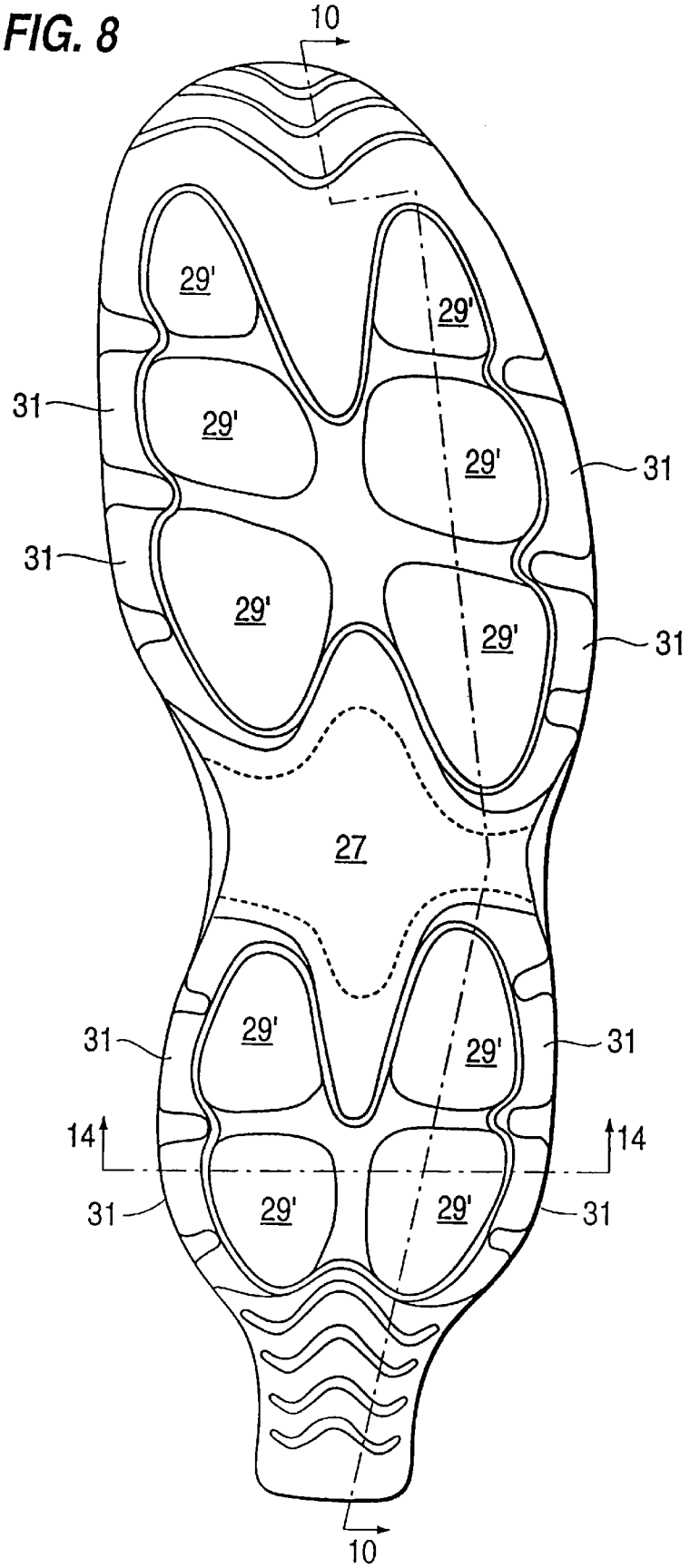
FIG. 8 is a bottom plan view of the outsole of the shoe shown in FIG. 3.
Figure 9:
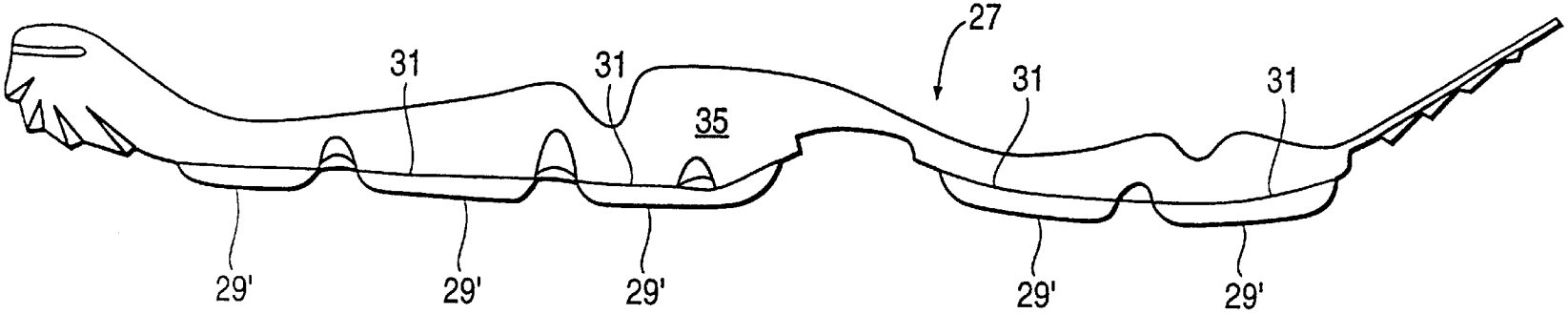
FIG. 9 is a lateral side elevation view of the outsole shown in FIG. 8.
Figure 10:
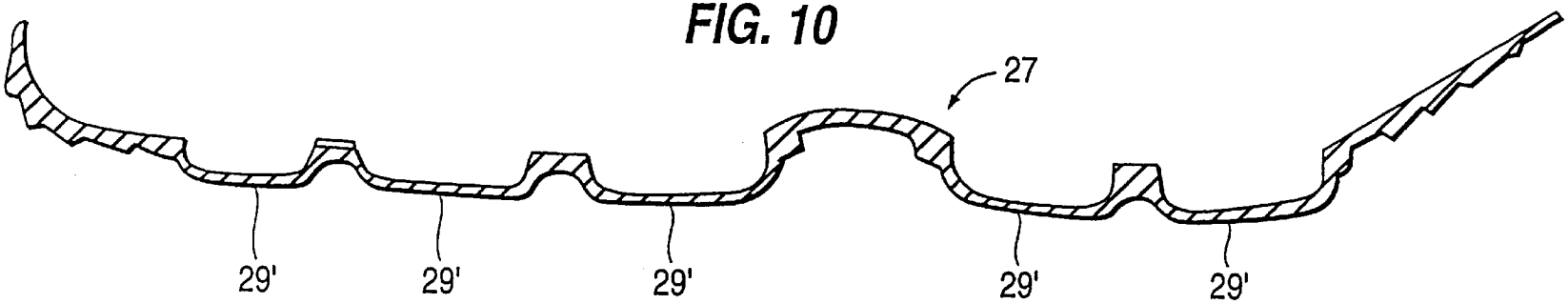
FIG. 10 is a longitudinal cross-sectional view taken on line 10—10 in FIG. 8.
Figure 11:
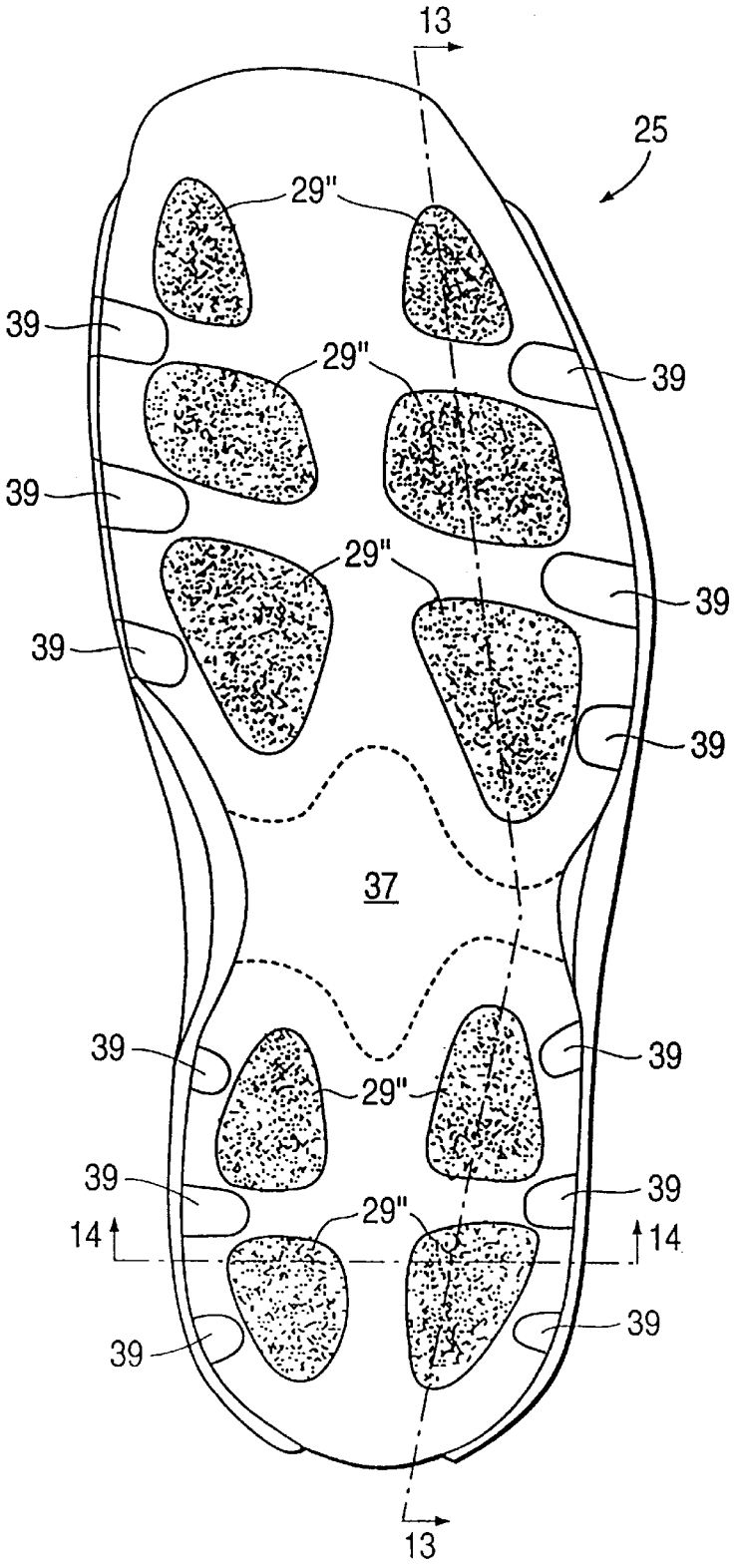
FIG. 11 is a bottom plan view of a midsole of the shoe shown in FIG. 3.
Figure 12:
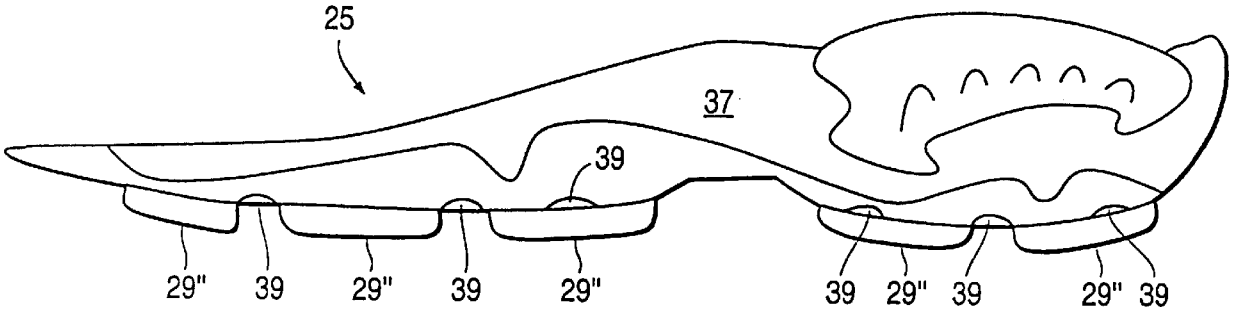
FIG. 12 is a lateral side elevation view of the midsole shown in FIG. 11.
Figure 13:
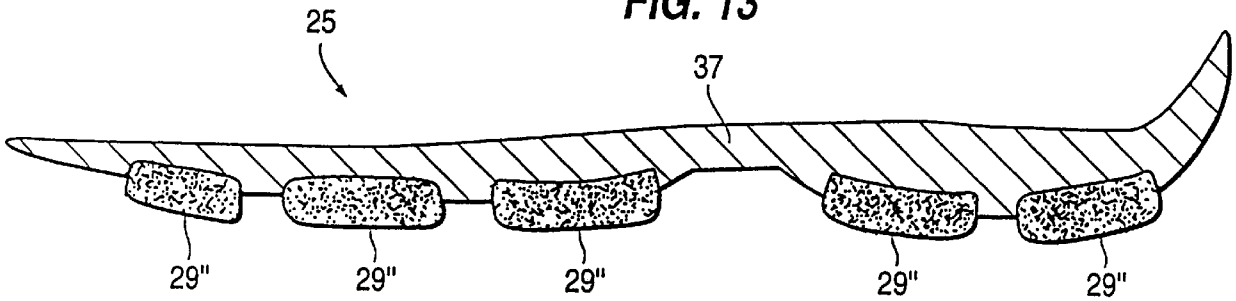
FIG. 13 is a longitudinal cross-sectional view taken on line 13—13 in FIG. 11.
Figure 14:
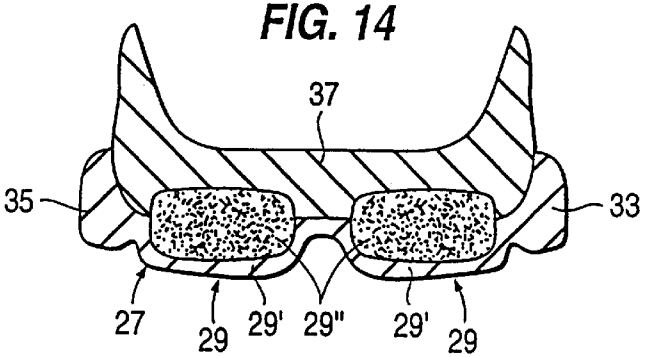
FIG. 14 is a transverse cross-sectional view of an assembly of the outsole of FIG. 8 and the midsole of FIG. 11, taken on lines 14—14 in FIGS. 8 and 11.

The operational principles of the inventive footwear will be clear from FIGS. 4–7. FIG. 4 shows shoe 21 at the instant of initial ground engagement (heel strike). The rearmost two pairs of pods 29 have engaged the ground and have just begun to compress, attenuating impact forces and increasing the area of ground contact. In FIG. 5, the wearer's weight and momentum have been largely transferred to the heel of shoe 21 and, as a result the rearmost two pairs of pods have compressed to the point that adjacent lugs 31 (in the heel region) are brought into gripping ground contact. In FIG. 6, the foot has rotated to bring the ball of the foot down, thus initiating ground contact and compression of pods 29 in the forefoot region. In FIG. 7, the two rearmost forefoot pod pairs have partially compressed to bring the adjacent lugs 31 into gripping ground contact.

FIGS. 8–14 illustrate more clearly how midsole 25 and outsole 27 are configured to come together to form the combination of relatively soft pods 29 and hard lugs 31. In particular, it will be noted that in this embodiment, the wear resistant layers covering the pods are formed as cups 29', integral with single piece outsole 27. Midsole 25 of this embodiment comprises a main body 37 formed of a first resilient foam material. Indentations 39 (see FIG. 11 and 12) correspond to the divisions in outsole 27 which demarcate lugs 31. Attached to main body 37 are separate pads 29" of a resilient foam material which will form the cores of pods 29. The material of pads 29" could be the same as, or different than, the material of main body 37. Obviously, pads 29" and main body 37 could be formed integrally as a single piece.

Figure 15:
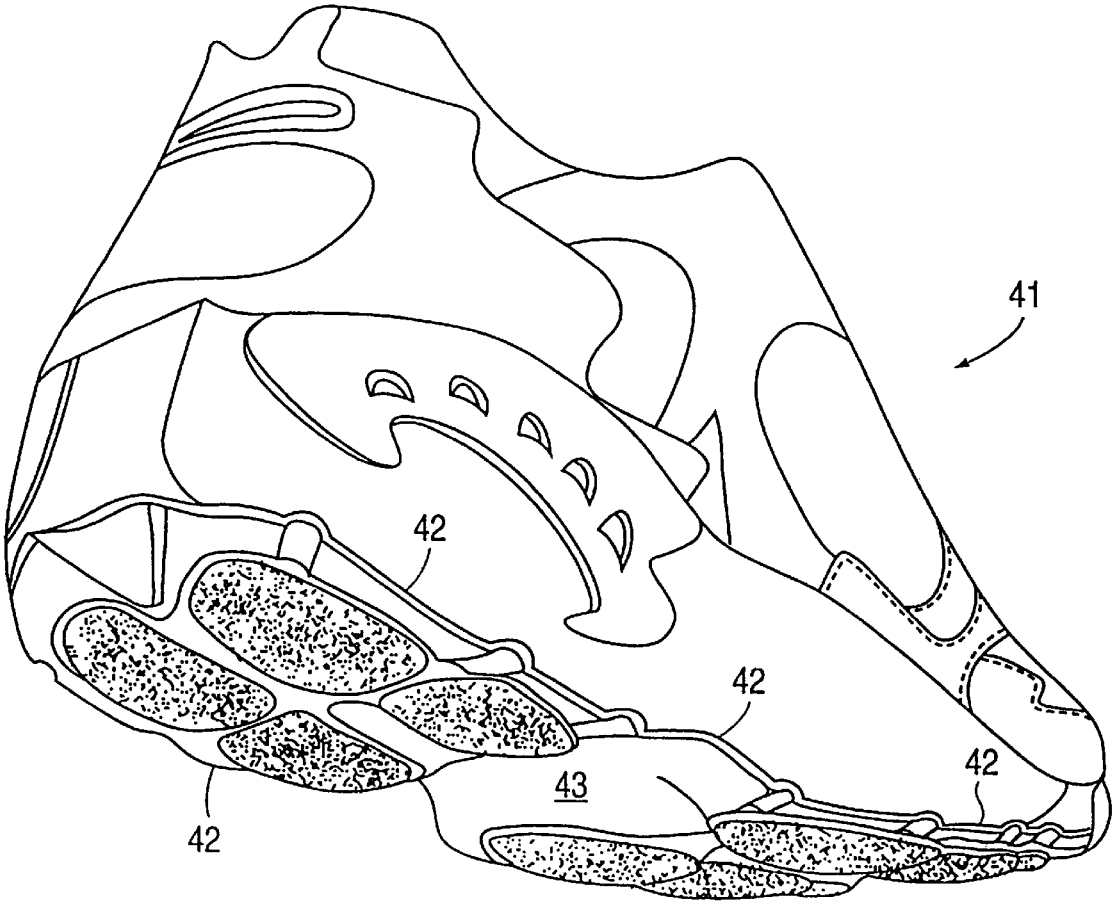
FIG. 15 is a perspective view illustrating a sole construction of a third lighter weight trail shoe embodiment of the invention.
Figure 16:
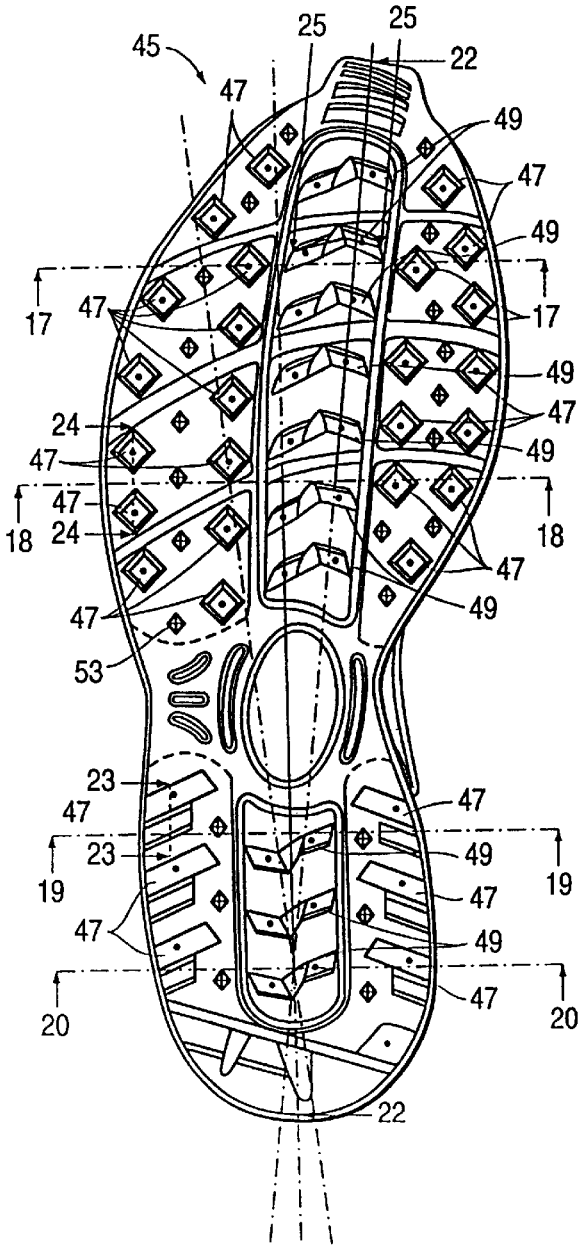
FIG. 16 is a bottom plan view of an outsole of a shoe representing a fourth embodiment of the invention.

FIG. 15 shows a third embodiment of the invention, in an on/off road running shoe 41. The construction of shoe 41 is essentially the same as the second embodiment, except that the thicknesses of the medial and lateral sides 42 of the outsole 43 are cut-back substantially to the thickness of the outsole web. This results in a weight reduction and greater sole flexibility, making the shoe best suited for light terrain and hard surfaces, where extra stability, e.g., for negotiating highly irregular surfaces, is not required.

Figure 17:
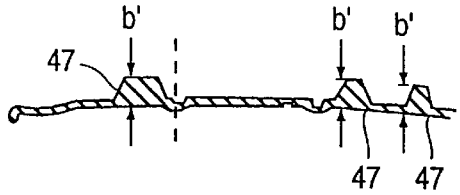
FIG. 17 is a transverse cross-sectional view taken on line 17—17 in FIG. 16.
Figure 18:
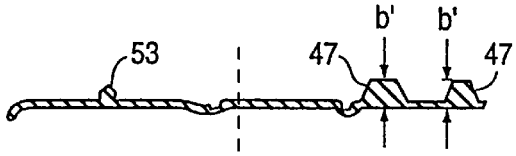
FIG. 18 is a transverse cross-sectional view taken on line 18—18 in FIG. 16.
Figure 19:
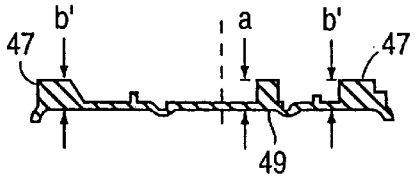
FIG. 19 is a transverse cross-sectional view taken on line 19—19 in FIG. 16.
Figure 20:
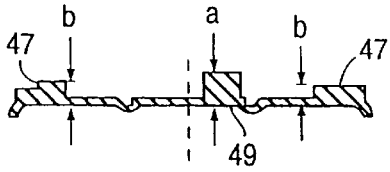
FIG. 20 is a transverse cross-sectional view taken on line 20—20 in FIG. 16.
Figure 21:
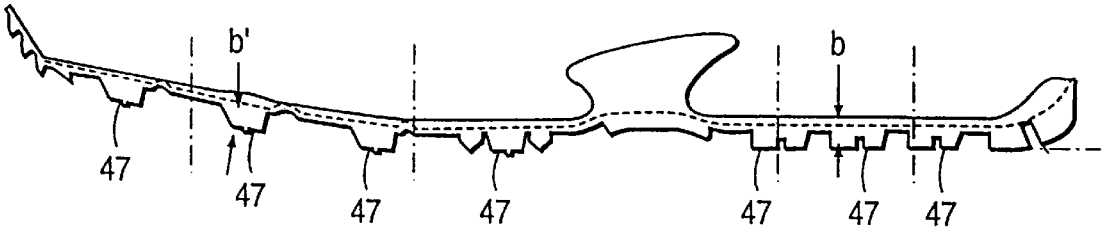
FIG. 21 is a medial side elevation view of the outsole shown in FIG. 16.
Figure 22:
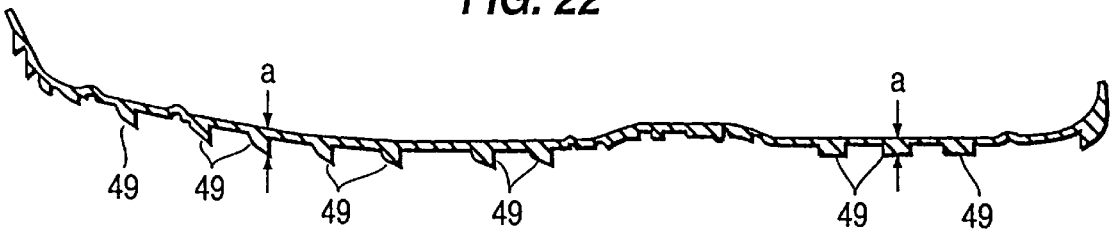
FIG. 22 is a longitudinal cross-sectional view taken on line 22—22 in FIG. 16.
Figure 23:
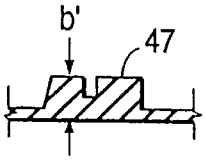
FIG. 23 is a cross-sectional view taken on line 23—23 in FIG. 16.
Figure 24:
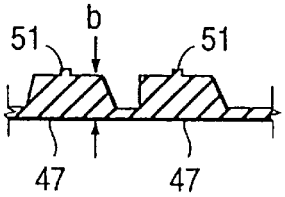
FIG. 24 is a cross-sectional view taken on line 24—24 in FIG. 16.
Figure 25:
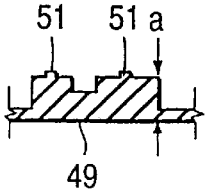
FIG. 25 is a cross-sectional view taken on line 25—25 in FIG. 16.

Referring now to FIGS. 16–25, a fourth embodiment of the invention is illustrated, wherein relatively soft outsole lugs are substituted for the soft pods of the previous embodiments, to provide a degree of the aforementioned traction and stability benefits, with a more conventional (less goat hoof-like) sole appearance. In particular, an outsole 45 has, like the previous embodiments, an outer perimetric border region including a plurality of relatively hard lugs 47 serving to increase traction by providing relatively rigid catches for irregular and soft ground surfaces. An interior region surrounded by the border region includes a plurality of relatively soft outsole lugs 49 which compress more easily to enhance cushioning and to increase traction on smooth hard surfaces. The height of relatively hard lugs 47 can vary, as can the height of relatively soft lugs 49. Preferably, a height dimension (a) of all or some of lugs 49 exceeds a height dimension (b) of relatively hard lugs 47, by about 1–2 mm, so that lugs 49 make initial ground contact and function, in conjunction with the hard lugs, similar to the pods of the previous embodiments. For example, dimension (a), including an outsole web thickness of 1.5 mm, may be 6.5 mm, wile dimension () may be 5.5 mm, as shown in FIG. 20. As best seen in FIGS. 17–19, the height (b') of some of the relatively hard lugs 47 can be increased to equal the dimension (a) of lugs 49. The particular shapes and patterns of lugs 47 and 49 may be varied. Preferably, however, a pair of relatively hard lugs 47 will flank each of relatively soft lugs 49. Additional traction may be provided by one or more small nubs 51 (e.g., with a height of 0.5 mm) of hard rubber positioned on lugs 47 and 49. Secondary (smaller) lugs 53 may also be provided in one or both of the interior and perimetric border regions.

Wear resistant rubber outsole compounds, as are known in the art, may be used to form outsole 45, including blends of natural rubber, NBR (nitrile) rubber and/or polybutyldiene rubber. For purposes of the present invention, the essential factor is a differential hardness of lugs 47 and 49. In this respect, and as one example, the material used for relatively hard lugs 47 may have a durometer rating (Shore A) in the range of 62–68, whereas the material of relatively soft lugs 49 may have a durometer rating (Shore A) in the range of 48–54.

Figure 26:
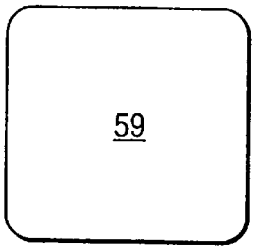
FIG. 26 PRIOR ART
FIG. 26 is a top plan view of a prior art outsole lug.
Figure 29:
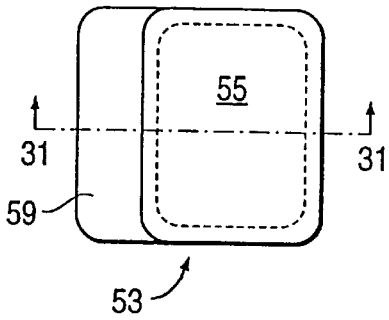
FIG. 29 is a top plan view of a combination lug in accordance with a fifth embodiment of the invention.
Figure 30:
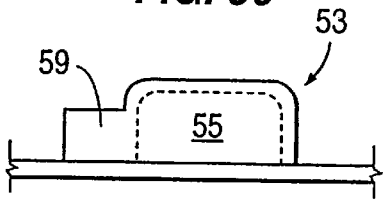
FIG. 30 is a side elevation view of the lug shown in FIG. 29.
Figure 27:
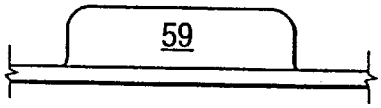
FIG. 27 PRIOR ART
FIG. 27 is a side elevation view of the prior art lug shown in FIG. 26.
Figure 31:
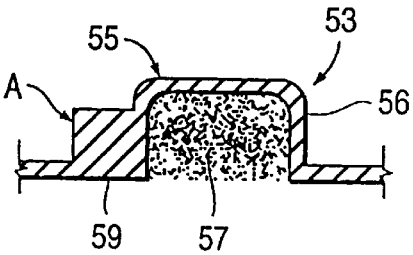
FIG. 31 is a cross-sectional view taken on line 31—31 in FIG. 29.

A fifth embodiment of the invention is illustrated in FIGS. 29–32, wherein a shoe has a midsole/outsole construction including relatively soft pods and adjacent relatively hard lugs integrally formed as first and second portions of a combination lug 53. A first portion 55 comprises a relatively thin layer 56 of rubber outsole material covering a core 57 of soft resilient foam material, similar to the first three embodiments. A second portion 59 comprises a solid block of rubber outsole material providing a harder lower profile protective edge. Second portion 59 serves the purpose of the hard lugs in the previous embodiments. In comparison, a solid block of rubber outsole material forms the entirety of a conventional outsole lug 59, as shown in FIGS. 26–28.

Figure 28:
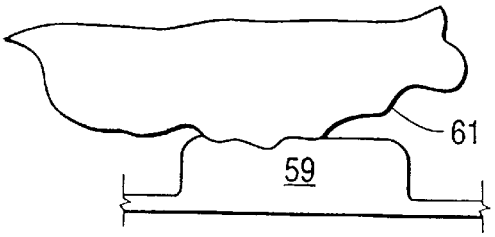
FIG. 28 PRIOR ART
FIG. 28 is a side elevational view of the lug shown in FIG. 26, upon impact with a rock.
Figure 32:
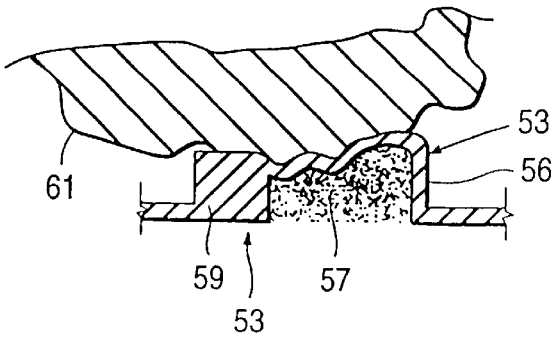
FIG. 32 is a cross-sectional view like FIG. 31, showing impact of the lug with a rock.
Figure 33:
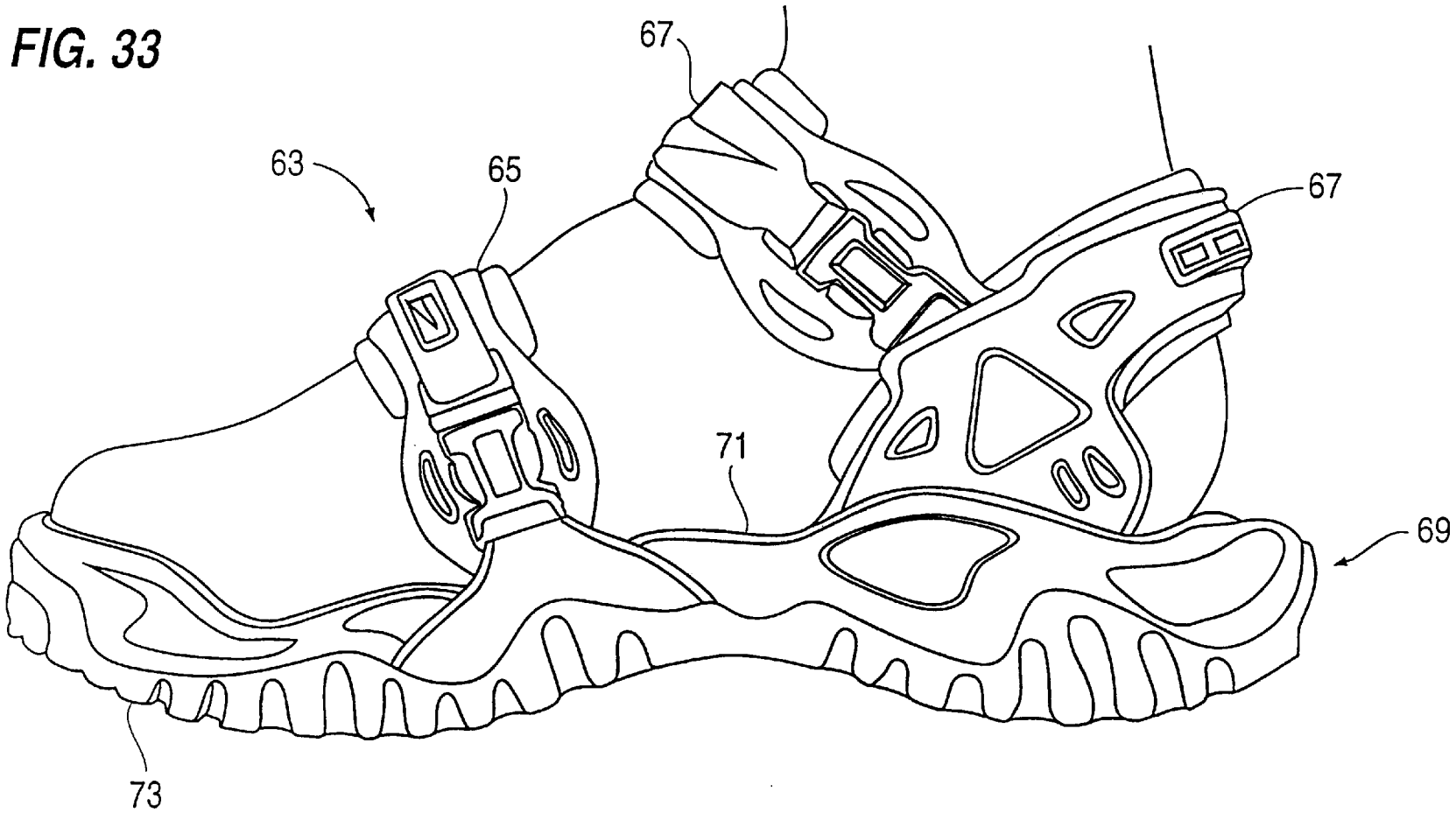
FIG. 33 is a side elevation view of a sandal representing a sixth embodiment of the invention.

The traction and stability enhancing effect of the present invention is illustrated by way of FIGS. 28 and 32, which show, respectively, impact of conventional lug 59 and combination lug 53 with an irregular rocky surface 61. Note in FIG. 28 the low area of contact of conventional lug 59 with surface 61. On the other hand, note in FIG. 32 the greater area of contact between combination lug 53 and surface 61, resulting in greater traction and improved stability. In addition, the protective edge provided by second portion 59 prevents the soft pod of first portion 55 from being totally compressed (bottomed-out) and from bending or flopping freely from side-to side. In the absence of second portion 59, the soft pod could, by virtue of such motion, create instability and wear excessively, e.g., due to abrasion.

In accordance with a preferred embodiment of the invention, a plurality combination lugs 53 are provided on the sole, taking the place of, or supplementing, conventional solid rubber outsole lugs. It is also preferable to orient the combination lugs such that the hard protective edges extend longitudinally along the medial and lateral sides of the sole.

Figure 34:
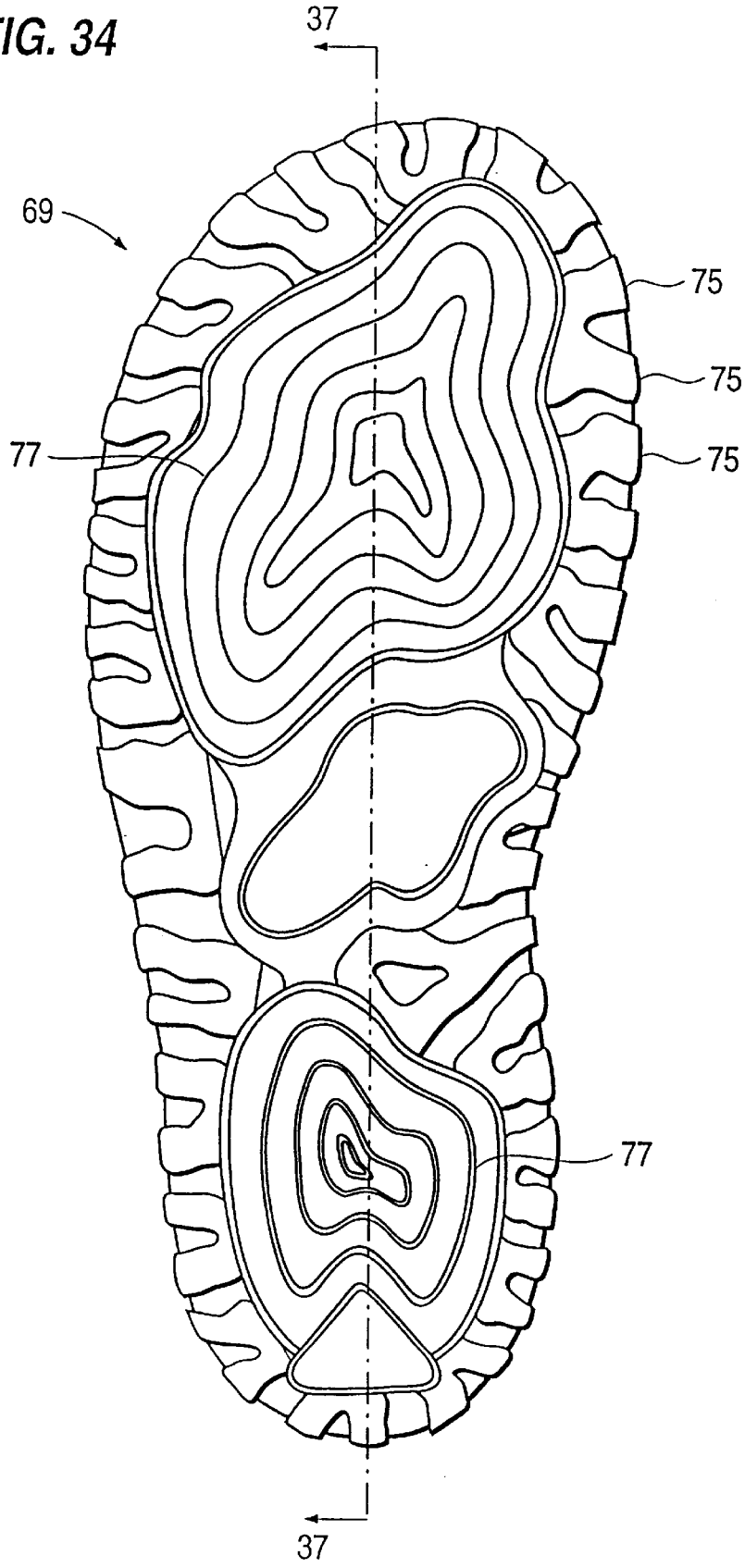
FIG. 34 is a bottom plan view of the sole (only outsole visible) of the sandal shown in FIG. 33.

Referring now to FIGS. 33–38, a sixth embodiment of the invention is in the form of a sandal, particularly a water sandal 63 well suited for sandy and rocky beach environments. Sandal 63 comprises adjustable forefoot and rearfoot straps 65, 67 secured to a lightweight sole 69. Sole 69 includes, like the previous embodiments, a cushioning midsole 71 and an outsole 73 of wear resist rubber or the like. Similar to the first three embodiments, and as best seen in FIG. 34, the midsole/outsole combination of sole 69 forms a ground engaging surface including a perimetric border region and an interior region surrounded by the border region. Extending throughout the perimetric border region are a plurality of relatively hard outsole lugs 75 for optimizing traction on loose and irregular surfaces. On the other hand, in place of the pairs of relatively soft pods, as in the first three embodiments, the interior region of sole 69 includes relatively soft traction elements in the form of relatively large, soft generally planar midsole regions (which do not necessarily protrude) covered with a relatively thin layer of outsole material. As shown, the outsole material may include shallow ridges 77 or the like.

In the interior forefoot area, relative softness is provided by a foam midsole insert 79 which is softer than the material used for the remainder of the midsole. On the other hand, in the interior heel area, relative softness may be obtained by encapsulating or otherwise fitting a low pressure fluid, e.g., gas, bladder 81 in the midsole material. The relative softness of the interior traction elements or regions allows the regions to absorb surface irregularities, similar to the relatively soft pods and lugs of the previous embodiments.

Figure 35:
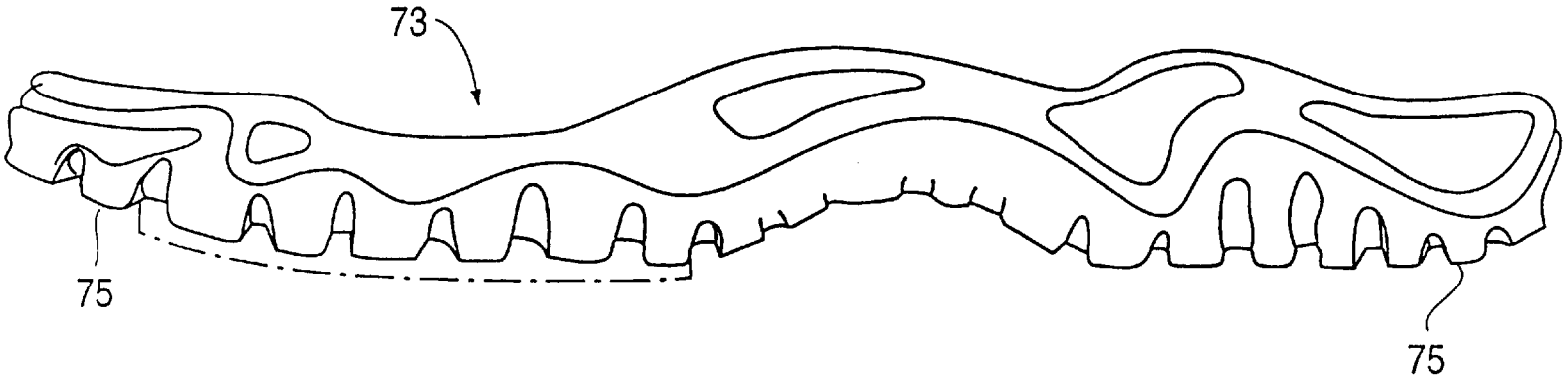
FIG. 35 is a medial side view of the outsole shown in FIG. 34.
Figure 36:
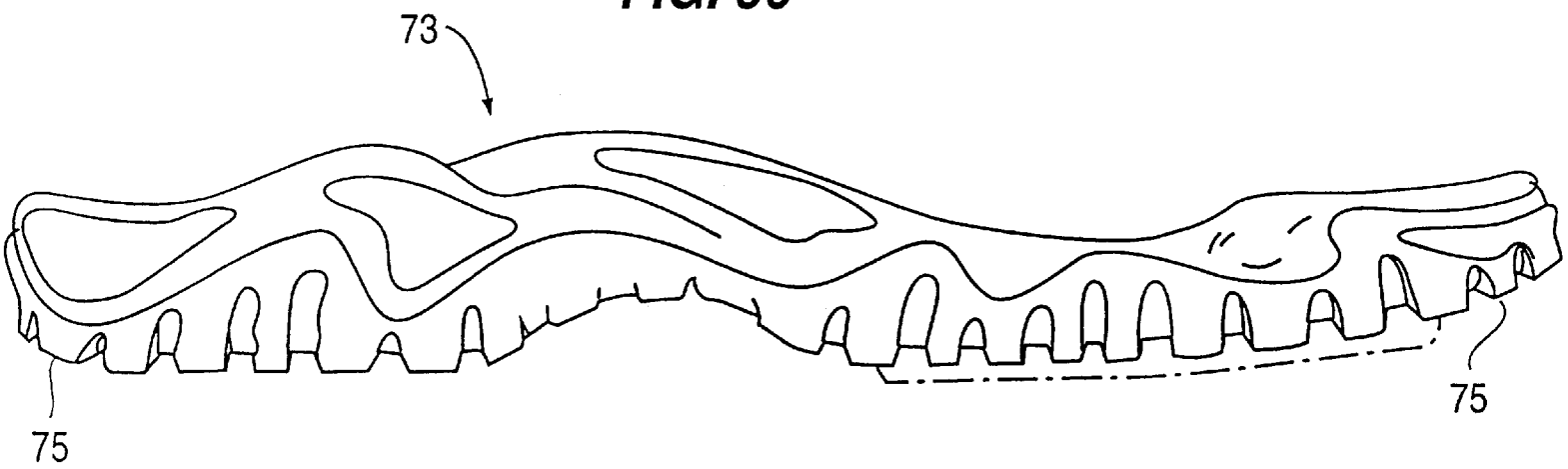
FIG. 36 is a lateral side view of the outsole shown in FIG. 34.
Figure 37:
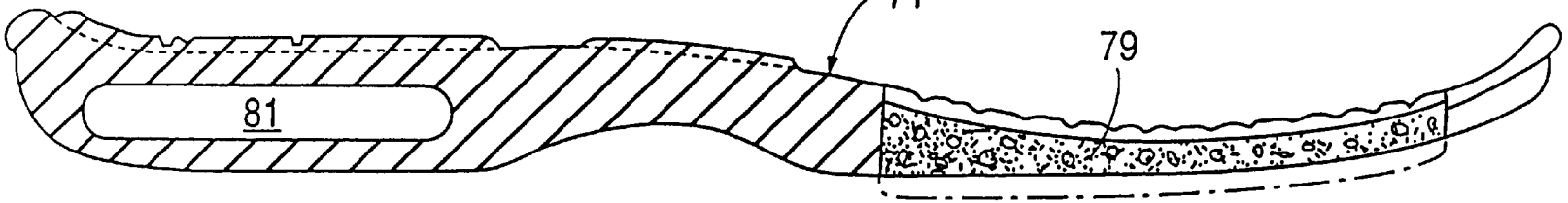
FIG. 37 is a longitudinal cross-sectional view of the midsole of the sole shown in FIG. 34, taken on line 37—37 in FIG. 34.
Figure 38:
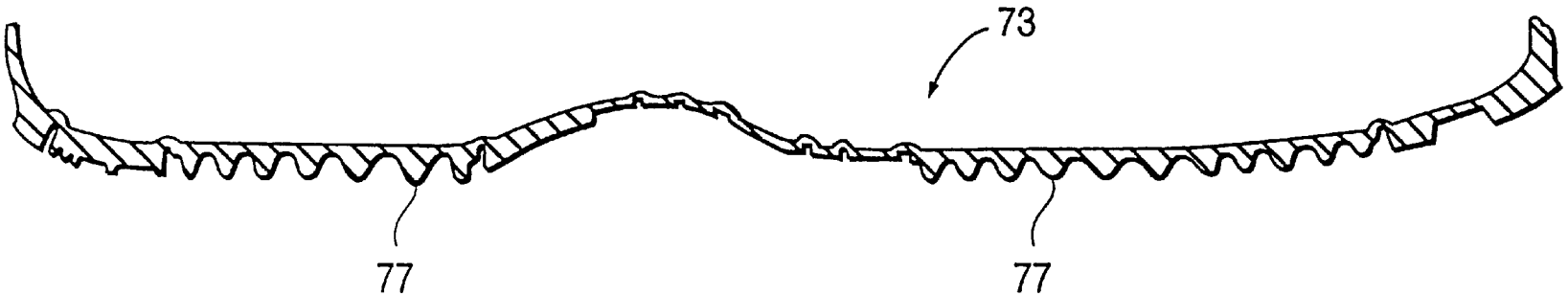
FIG. 38 is a longitudinal cross-sectional view of the outsole shown in FIG. 34, taken on line 37—37 in FIG. 34.

As illustrated by the phantom lines in FIGS. 35–37, midsole insert 79 may protrude below lugs 77, creating a relatively soft traction elements similar to (but larger than) the soft pods of the first three embodiments, whereby the previously mentioned additional advantages of making first contact with the softer elements may be obtained. In this case, outsole 73 would be modified to include a corresponding shallow cup for receiving the protruding part of the insert.

The present invention has been described in terms of preferred and exemplary embodiments thereof. Other embodiments, modifications and variations within the scope and spirit of the appended claims will occur to persons of ordinary skill in the art from a review of this disclosure.

What is claimed is:

1. Footwear comprising an upper and a cushioning sole attached to said upper, said sole having a ground engaging surface including a group of traction elements and a group of lugs adjacent said group of traction elements; wherein:

said ground engaging surface comprises an outer perimetric border region and an interior region surrounded by said border region, said group of traction elements being located within said interior region, said group of lugs being located within said border region; and said traction elements are formed as pods, said pods comprising a pair of pods in at least one of a rear foot region and a forefoot region, the pods within the pair being spaced laterally from each other, only two abreast, to create a laterally spaced pair of contact areas in at least one of the rearfoot and forefoot regions, said pair of pods having pods of generally triangular shape defining therebetween a generally wedge-shaped gap, each of said pair of pods being located adjacent a said lug in said border region, and being larger in size than the ad adjacent lug.

2. Footwear according to claim 1, wherein said pair of pods is located in said forefoot region.

3. Footwear comprising an upper and a cushioning sole attached to said upper, said sole having a ground engaging surface including a group of relatively soft compliant traction elements and a group of relatively hard lugs, stiffer in compression than said traction elements, adjacent said group of traction elements; wherein:

said ground engaging surface comprises an outer perimetric border region and an interior region surrounded by said border region, said group of relatively soft traction elements being located within said interior region, said group of relatively hard lugs being located within said border region; and said relatively soft traction elements are formed as pods, said pods comprising a pair of pods in at least one of a rear foot region and a forefoot region, the pods within the pair being spaced laterally from each other, only two abreast, to create a laterally spaced pair of contact areas in at least one of the rearfoot and forefoot regions, said pair of pods having pods of generally triangular shape defining therebetween a generally wedge-shaped gap, each of said pair of pods being located adjacent a said lug in said border region, and being larger in size than the adjacent lug.

4. Footwear according to claim 3, wherein said pair of pods is located in said forefoot region.

5. Footwear comprising an upper and a cushioning sole attached to said upper, said sole having a ground engaging surface including a group of relatively soft compliant traction elements and a group of relatively hard lugs, stiffer in compression than said traction elements, adjacent said group of traction elements, said traction elements extending downwardly below said lugs such that, in use, a bottom surface of said traction elements will make initial ground contact and partially compress to cushion impact of ground engagement and increase ground contact, and such that a bottom surface of said lugs is brought into ground contact after said initial ground contact, wherein said lugs limit compression of said traction elements and serve as a relatively rigid catch for irregular and soft ground surfaces; wherein:

said ground engaging surface comprises an outer perimetric border region and an interior region surrounded by said border region, said group of relatively soft traction elements being located within said interior region, said group of relatively hard lugs being located within said border region; and said relatively soft traction elements are formed as pods, said pods comprising adjacent pairs of pods in at least one of a rear foot region and a forefoot region, the pods within the pair being spaced laterally from each other, only two abreast, to create laterally spaced pairs of initial contact areas in the rearfoot and forefoot regions, said pair of pods having pods of generally triangular shape defining therebetween a generally wedge-shaped gap, each of said pair of pods being located adjacent a said lug in said border region, and being larger in size than the adjacent lug.

6. Footwear according to claim 5, wherein said pair of pods is located in said forefoot region.

* * * * *